United States Patent [19]

Pearce

[11] 4,011,555

[45] Mar. 8, 1977

[54] RADIO AND TELEVISION ALARM SYSTEM

[75] Inventor: Jack L. Pearce, Roseville, Mich.

[73] Assignee: Monte Markowitz, Southfield, Mich. ; a part interest

[22] Filed: Aug. 20, 1974

[21] Appl. No.: 498,943

[52] U.S. Cl. ..... 340/280; 340/283; 340/384 E

[51] Int. Cl.[2] ..... G08B 21/00

[58] Field of Search ..... 340/280, 283, 248 D, 340/253 C, 253 Q, 421, 288, 216, 384 E, 276

[56] References Cited

UNITED STATES PATENTS

| | | | |
|---|---|---|---|
| 3,346,857 | 10/1967 | Cromer | 340/384 E |
| 3,425,050 | 1/1969 | Tellerman et al. | 340/280 |
| 3,553,673 | 1/1971 | Fistell | 340/280 |
| 3,696,380 | 10/1972 | Murphy | 340/283 |
| 3,765,008 | 10/1973 | Lowry | 340/280 |
| 3,805,231 | 4/1974 | Santoli | 340/63 |

OTHER PUBLICATIONS

Hank Olson, "A One-Chip, Two Tone Generator," Apr. 1974, pp. 48, 49.

*Primary Examiner*—John W. Caldwell
*Assistant Examiner*—Donnie L. Crosland
*Attorney, Agent, or Firm*—Harness, Dickey & Pierce

[57] ABSTRACT

An alarm system which is particularly adapted for use in connection with an appliance, the system sensing the removal of the power supply plug from the convenience outlet to trigger an audio alarm. The system includes a one hertz oscillator circuit which feeds a one hertz signal to a one kilohertz oscillator signal including an input gate circuit, the output of the one kilohertz oscillator circuit feeding an output transformer connected to the audio signaling device upon triggering of the one kilohertz oscillator circuit. The system further includes a gating device, in the form of a controlled rectifier, the gate and cathode electrodes of which are connected to a source of alternating current supplied through the plug and convenience outlet assembly whereby the controlled rectifier is triggered to the conductive state to permit conduction of a multiple frequency signal through the output transformer and gate circuit upon removal of the power supply plug from the convenience outlet. There is provided a reset circuit including a reset switch which shunts the controlled rectifier, the reset switch being actuated from a position external to the appliance cabinet.

6 Claims, 2 Drawing Figures

FIG. 2.

RADIO AND TELEVISION ALARM SYSTEM

BACKGROUND AND SUMMARY OF THE DISCLOSURE

This invention relates generally to an alarm system for an appliance and more particularly to an appliance alarm system which is adapted to sense the availability of an alternating current supply for the appliance and to trigger an alarm when that source of supply has been cut-off as, for example, by removing the plug from the convenience outlet.

With the heavy concentration of people in urban areas, it has been discovered that the rate of unlawful entry into private homes for the purpose of removing articles from those homes has been on a steady increase. This situation has resulted in a rise in the cost of insurance rates to protect these goods, and in certain instances it has become extremely difficult to obtain insurance to cover the theft of goods from a home. The primary targets of a theft from a private home are television sets and radio receivers, and it is with this problem that the invention primarily deals.

There have been systems proposed in the past for protecting television and radio sets from theft. However, these systems have been extremely complicated and somewhat ineffective. The system of the present invention has been designed to cure the shortcomings of the prior systems while at the same time insuring that the alarm system is inconspicuous, difficult to remove by the thief and inexpensive to install.

OBJECTS AND BRIEF DESCRIPTION OF THE DRAWINGS

Accordingly, it is one object of the present invention to provide an improved alarm system for use in conjunction with appliances which are adapted to be plugged into a source of alternating current supply.

It is another object of the present invention to provide an improved alarm system for appliances of the type described which is reliable in operation, easy to install and inexpensive to manufacture.

It is a further object of the present invention to provide an improved alarm system for use in conjunction with appliances of the type described which is easy to reset by the homeowner if the power should fail or if it is desired to move the appliance from one location to another, while at the same time making it difficult for a thief to move the appliance from one location to another.

Further objects, features and advantages of the present invention will become apparent from a reading of the specification and claims when taken in conjunction with the attached drawings in which:

FIG. 1 is a top view of a television set, partially broken away, illustrating the installation of the system of the present invention; and FIG. 2 is a schematic diagram illustrating the specific details of the circuitry of a preferred embodiment of the present invention.

DETAILED DESCRIPTION OF THE DRAWINGS

Figure 1:
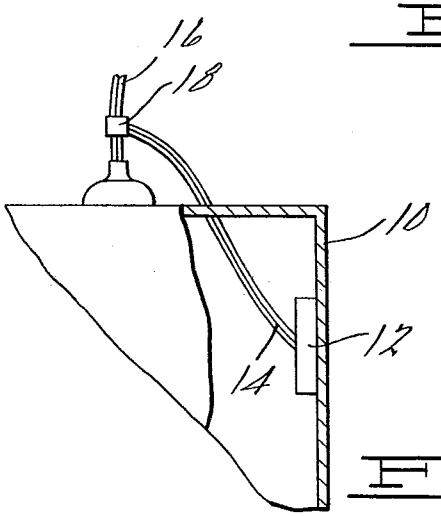

Referring now to FIG. 1, there is illustrated a television set 10 into which the present invention has been incorporated. It is to be understood that, while the following description will be particularly applied to a television set, any other appliances having a non-metallic cabinet and being supplied from a source of alternating current potential which is plugged into a convenience outlet may utilize the system of the present invention.

Figure 2:
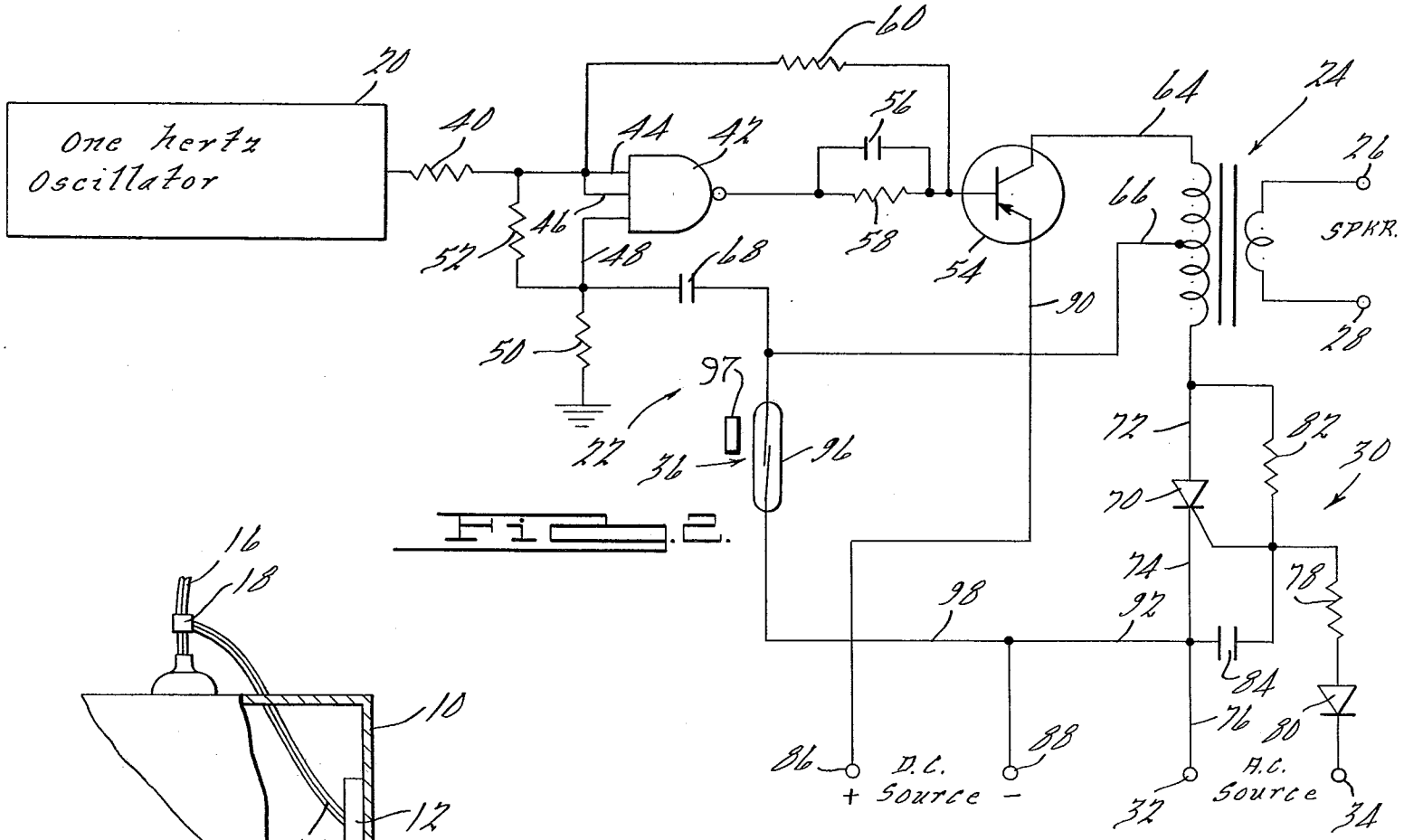

Specifically, the circuit of FIG. 2 is incorporated into a box 12 to which is connected a pair of leads 14. The leads 14 are adapted to sense the availability of alternating current at input conductor 16 while the appliance is either turned on or off. The input conductors 16 are the normal conductors associated with television sets and which utilize a male plug which is adapted to be plugged into a convenience outlet. The connection between conductors 14 and 16 is made by a connector element 18, the connector element 18 being of any type presently being commercially marketed wherein the connection is encased within an external housing thereby precluding the user from being shocked through contact with the connector element or through exposed conductors. The preferred unit presently being commercially marketed incorporates prongs which are adapted to be inserted into the insulation of conductors 16, the prongs being electrically connected to the conductors 14 thereby making an electrical connection between conductors 14 and 16. A housing is then inserted over the prongs to completely enclose the connection.

With the arrangement described, upon removal of the male plug associated with conductors 16 from the convenience outlet, an audible device, for example the television speaker, is energized to produce a loud, multiple frequency signal. This audible signal will remain until the circuit of FIG. 2 has been reset. It is to be noted that merely reinserting the plug into the convenience outlet will not reset the circuit as will become readily apparent from the following description of FIG. 2.

Referring now to FIG. 2, there is illustrated a preferred embodiment of a circuit incorporating the features of the present invention. Specifically, the system includes a one hertz oscillator circuit 20 which may be any oscillator circuit presently on the market. In the system of the present invention, an MC 7410 chip has been utilized and particularly two-thirds of the chip are cross-coupled with capacitors to form the one hertz oscillator. The output of the one hertz oscillator is fed to the input circuit of a multiple frequency, chosen to be 500 hertz and one kilohertz, oscillator circuit and output circuit 22. The output circuit supplies a three frequency signal to an output transformer 24 connected to the television speaker at terminals 26, 28. The energization of the transformer is controlled by a controlled rectifier gate circuit 30 which is maintained in the off state by the source of alternating current potential at intput terminals 32, 34 as will be more fully explained hereinafter.

The alternating current supply, when present, holds down the gate signal so that the controlled rectifier is not triggered. Upon removal of the alternating current source, the controlled rectifier gate circuit 30 is rendered conductive to permit the three frequency oscillation to occur at the output transformer 24. Thus, a three frequency audible signal is fed to the speaker connected to the terminals 26, 28. The system is reset by means of a reset circuit 36 which is connected in shunt with the controlled rectifier gate circuit 30 to render the controlled rectifier nonconductive. The controlled rectifier will remain nonconductive if the plug has been reinserted into the convenience outlet and an alternating current source of potential is present before the reset circuit is actuated.

Referring now to the specifics of the system just described, the output of the one hertz oscillator is fed to the input circuit of the double frequency oscillator 22 by means of a resistor 40. The resistor is connected at the right end thereof to a three terminal nand gate 42 (the third portion of the MC 7410 chip), the upper two terminals being connected together by means of conductors 44, 46. The lower input terminal of the nand gate 42 is connected to ground by means of a conductor 48 and a resistor 50, the upper two inputs being connected to the lower input by means of a resistor 52. The output of gate 42 is fed to a PNP transistor 54 through an RC network including a capacitor 56 and a resistor 58, the capacitor 56 and resistor 58 forming a coupling network between the gate 42 and the transistor 54. Also, the one hertz signal is fed forward to the base electrode of transistor 54 by means of a resistor 60 coupled between the upper inputs to gate 42 and the base electrode of transistor 54.

The output of transistor 54 is connected to the transformer 24, and particularly to the primary winding thereof, by means of a conductor 64 connected between the collector electrode of transistor 54 and the upper end of the primary winding of transformer 24. The primary winding of transformer 24 is center-tapped, the output of the center-tap being fed back to the lower input of gate 42 by means of a conductor 66, a capacitor 68 and the conductor 48.

Main power through the transformer 24 is controlled by the controlled rectifier gate circuit 30, and specifically by the conductive and nonconductive condition of a controlled rectifier 70, the anode of which is connected to the bottom of the primary winding of transformer 24 by means of a conductor 72 and the cathode of which is connected to one side of the alternating current source at terminal 32 by means of conductors 74, 76. The gate electrode is connected to the other side of the alternating source at terminal 34 through a resistor 78 and a diode 80. The anode and gate electrodes are coupled by means of a resistor 82 and the gate and cathode electrodes are coupled by means of a capacitor 84.

A suitable source of direct current supply for the semi-conductor circuit is supplied by means of a d.c. source of potential, for example, a battery, connected to input terminals 86, 88, the terminal 86 being connected to the emitter electrode of transistor 54 by means of a conductor 90. The negative source at terminal 88 is connected to the cathode electrode by means of a conductor 92.

The system is reset by means of a reed switch 96 which is connected to the anode electrode of controlled rectifier 70 by means of the conductor 66, the lower portion of the primary winding of transformer 24 and the conductor 72. The other end of the reed switch 96 is connected to the cathode electrode of controlled rectifier 70 by means of a conductor 98 and the conductors 92 and 74.

In operation, the unit is installed as indicated in FIG. 1 and a battery is applied to the terminals 86, 88. As stated above, the alternating current source, when available, holds down the gate electrode of controlled rectifier 70 until such time as the source of alternating current potential is removed as, for example, by pulling out the plug from the convenience outlet. Upon this occurrence, the one hertz oscillator which has been oscillating during the period that the system is on, supplies a signal to the gate 42 by means of the resistor 40 and the resistor 52. Also, the signal is fed forward to transistor 54 by means of the resistor 60.

Assuming that a positive signal is fed to the gate 42, the output of the gate 42 will drop to a zero level signal, which signal is fed to the transistor 54 to turn transistor 54 off. With transistor 54 off, the collector electrode thereof drops to a negative value, this signal being fed back to the gate 42 through the upper portion of the transformer primary winding 24 by means of the conductor 66, the capacitor 68 and the conductor 48. This causes the gate 42 to revert to the original state and thereby turn transistor 54 on. These oscillations occur at a 1000 hertz. Also, the resistor 60 feeds the one kilohertz signal forward to the transistor 54, the addition of the resistor 60 causing the oscillator to also oscillate at 500 hertz. Thus, a one hertz a 500 hertz and a 1000 hertz signal are produced at the transformer 24. This signal is fed to the speaker of the television set to produce the audible tone described above.

This assumes that the controlled rectifier 70 has been turned on due to the removal of the hold down source at terminals 32, 34. Upon returning the hold down source to the terminals 32, 34, the controlled rectifier will continue to conduct due to the fact that there is no turn off signal present. However, if the reed switch 96 is actuated, the controlled rectifier 70 is shunted which will turn off the controlled rectifier.

In the preferred embodiment, the reed switch is actuated by means of a magnet 97 passed in the vicinity of the reed switch, but outside of the cabinet, the reed switch being mounted on the inside of the cabinet. Suitable coding mechanisms may be utilized as, for example, a plurality of reed switches connected in an and gate configuration with a plurality of coded magnets.

Typical circuit element values:

| Resistors | Value |
|---|---|
| 40 | 1000 ohms |
| 50 | 1000 ohms |
| 52 | 6800 ohms |
| 58 | 1000 ohms |
| 60 | 1000 ohms |
| 78 | 1 megohm |
| 82 | 3.9 megohms |
| **Capacitors** | **Value** |
| 56 | 10 microfarads |
| 68 | .47 microfarads |
| 84 | .1 microfarads |
| Transistor 54 | 2N404 |
| Controlled rectifier 70 | Ser 800 MH |
| Diode 80 | CR 500 MA |
| d.c. Source | 9 Volts |

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. An alarm system for a portable appliance which appliance is energized from a fixed source of alternating current potential by an electrical cord having two conductors adapted to conduct the a-c potential from the fixed source to the appliance comprising first oscillator circuit means for providing output gating pulses at a first preselected audio frequency, second oscillator circuit means electrically connected with said first oscillator means for providing an output signal at a second preselected audio frequency higher than said first audio frequency, output means electrically connected with said second oscillator means for providing a audible audio output alarm in response to said second output signal when in an enabled condition and providing no audio output when in a disabled condition, said second oscillator circuit means providing a pair of distinct audio frequency signals to said output means, said output means comprising solid state switching means having a first condition disabling said output means and a second condition enabling said output means, electrical circuit means connecting said solid state switching means to the two conductors utilized to conduct electrical energy from the fixed source to the appliance, said solid state switching means being operable independently of said first oscillator means and being in said first condition in response to the a-c potential being at the two conductors and being in said second condition in response to the a-c potential being absent at the two conductors whereby said audio output alarm will be sounded when the two conductors are removed from the a-c potential at the fixed source.

2. The improvement of claim 1 further including reset circuit means and actuating means for said reset circuit means, said solid state switching means including gate controller means operable for placing said solid state switching means in said second condition in response to a-c potential being absent at the two conductors, said reset circuits means resetting said solid state switching means to said first condition upon returning the source of electrical energy to the two conductors and operation of said actuating means.

3. The improvement of claim 2 with the appliance having an enclosure and wherein said reset circuit means is mounted within the enclosure of the appliance and said actuating means is operated outside of the enclosure, said output including a speaker mounted in the enclosure.

4. The improvement of claim 3 wherein said output means includes a transformer connected to said speaker, said solid state switching means including a three terminal semi-conductor device having a controlled electrode and having a pair of principal electrodes with said pair of principal electrode being connected in series circuit with said transformer, said solid state switching means being held down by the presence of the electrical energy at the two conductors.

5. The improvement of claim 4 wherein said gate controller means includes a two terminal semi-conductor device, said source of electrical energy being connected to said controlled electrode of said three terminal semi-conductor device, said reset circuit means is connected in shunt relation with said three terminal semi-conductor device, the operation of said actuating means causing said three terminal semi-conductor device to become nonconductive.

6. The improvement of claim 5 wherein said resetting means is a reed switch and said three terminal semiconductor device is a controlled rectifier, said controlled rectifier being rendered nonconductive in response to the closure of said reed switch by said actuating means, said actuating means being nonconductively coupled to said reed switch.

* * * * *